United States Patent [19]

Iguchi et al.

[11] 4,362,811

[45] Dec. 7, 1982

[54] PROCESSING SOLUTION COMPOSITION FOR SILVER COMPLEX DIFFUSION TRANSFER PROCESS

[75] Inventors: Shigeru Iguchi; Shozi Oka, both of Nagaokakyo, Japan

[73] Assignee: Mitsubishi Paper Mills Ltd., Tokyo, Japan

[21] Appl. No.: 282,152

[22] Filed: Jul. 10, 1981

Related U.S. Application Data

[63] Continuation of Ser. No. 102,104, Dec. 7, 1979, abandoned.

[30] Foreign Application Priority Data

Dec. 11, 1978 [JP] Japan ..... 53-153369

[51] Int. Cl.[3] ..... G03C 5/54; G03C 5/38; G03C 5/30

[52] U.S. Cl. ..... 430/455; 430/204; 430/234; 430/244; 430/251; 430/487; 430/489; 430/490

[58] Field of Search ..... 430/244, 248, 249, 251, 430/489, 490, 486, 455, 456, 227, 487, 234, 204

[56] References Cited

U.S. PATENT DOCUMENTS

| | | | |
|---|---|---|---|
| 2,113,312 | 4/1938 | Vittom | 430/489 |
| 2,197,017 | 4/1940 | Wood et al. | 430/489 |
| 3,335,009 | 8/1967 | Rasch et al. | 430/489 |
| 3,576,633 | 4/1971 | Henn et al. | 430/489 |
| 3,664,838 | 5/1972 | Amano et al. | 430/489 |
| 3,776,728 | 12/1973 | Suzuki et al. | 430/251 |
| 3,985,561 | 10/1976 | DeHaes | 430/251 |
| 4,075,014 | 2/1978 | Gerhardt | 430/487 |
| 4,147,543 | 4/1979 | Kubotera et al. | 430/456 |
| 4,168,166 | 9/1979 | Land | 430/251 |
| 4,298,673 | 11/1981 | Kubotera et al. | 430/249 |

*Primary Examiner*—Richard L. Schilling

*Attorney, Agent, or Firm*—Cushman, Darby & Cushman

[57] ABSTRACT

A processing solution composition for treating an image receiving layer in silver complex diffusion transfer process, which contains $1.7\times10^{-3}$ to $1.7\times10^{-2}$ mole/liter of a bromide and 2.0 to 12.0 mole-% of potassium ion based on total cations of the salts contained in the composition accelerates the transfer speed and gives a silver image high in maximum density, contrast and sharpness to the image.

15 Claims, No Drawings

PROCESSING SOLUTION COMPOSITION FOR SILVER COMPLEX DIFFUSION TRANSFER PROCESS

This is a continuation, of application Ser. No. 102,104 filed Dec. 7, 1979, now abandoned.

This invention relates to a processing solution composition for use in the silver complex diffusion transfer process.

The principle of silver complex diffusion transfer process (hereinafter referred to as DTR process) was described in U.S. Pat. No. 2,352,014 and the process has been made well known by many other related patents and the literature. In DTR process, the silver complex is transferred imagewise from the silver halide emulsion layer to an image receiving layer by diffusion and then transformed into a silver image usually in the presence of physical development nuclei. For this purpose, the imagewise exposed silver halide emulsion layer is disposed in contact or brought into contact with the image receiving layer in the presence of a developing agent and a solvent for silver halide to convert the unexposed silver halide into a soluble silver complex. In the exposed area of the silver halide emulsion layer, the silver halide is reduced to silver which is no longer soluble and, hence, is non-diffusible. In the unexposed area of the silver halide emulsion layer, the silver halide is converted into soluble silver complex which is transferred to the image receiving layer and forms a silver image usually in the presence of developing nuclei.

The application field of DTR process covers a wide range including reproduction of documents, preparation of lithographic printing plates, preparation of block copying materials, and instant photography.

In order to impart a high maximum density, contrast and sharpness to the silver image in the image receiving layer, it is important to accelerate the deposition of silver in said layer. This acceleration can be effected by the rapid development of the transferred silver complex such as, for example, thiosulfate silver complex to keep the silver complex from lateral diffusion, thus resulting in an improvement in contrast and sharpness. It was found, however, that the acceleration of silver deposition will not necessarily cause the improvement in reflection density of the silver image.

An object of this invention, therefore, is to provide a processing solution composition for use in DTR process, which accelerates the transfer speed and gives a silver image high in maximum density, contrast, and sharpness.

Another object of the present invention is to provide a process for treating silver complex diffusion transfer material which accelerates the transfer speed and gives a silver image high in maximum density, contrast and sharpness.

On the other hand, the addition of a variety of amines for various purposes to various processing solutions including the one for DTR process has been disclosed in, for example, Japanese Patent Publication Nos. 12,835/66, 30,856/72, 30,499/73, 43,813/73, 36,766/75 and 43,799/76.

According to the experimental results obtained by the present inventors, although so-called alkanolamines among various amines disclosed in the above patent literature are generally effective in improving the processing capacity of the processing solutions for DTR process, they present some problem or other, such as little improvement in transfer speed or in sharpness of the image, or the development of discoloration in the image receiving layer.

Particularly, a substituted aminoalcohol of the general formula R-NH-$C_2H_4OH$ (where R is a lower alkyl group having 1 to 4 carbon atoms) was found to improve markedly the transfer speed, contrast and sharpness, but decreases the density of transferred image.

Further another object of this invention is to provide a processing solution composition for DTR process containing additionally the above-noted substituted aminoalcohol, which accelerates the transfer speed and produces a silver image higher in maximum density, contrast and sharpness.

It has now been found that the aforementioned objects of this invention can be achieved by a DTR processing solution composition comprising $1.7\times10^{-3}$ to $1.7\times10^{-2}$ mole/liter of a bromide, the amount of potassium ion in the total cations of the salts contained in the composition being 2.0 to 12.0 mole-%. In a particularly preferred embodiment of this invention, the said amount of potassium ion is 6.0 to 10.0 mole-% and/or the composition contains a substituted aminoalcohol mentioned above and/or the bromide content is $3\times10^{-3}$ to $1.2\times10^{-2}$ mole/liter.

The processing solution for use in DTR process of the present invention essentially contains alkaline substances, e.g. sodium hydroxide, potassium hydroxide and sodium orthophosphate, preservatives, e.g. sodium sulfite, and antifogging agents, e.g. potassium bromide; and many additionally contain thickeners, e.g. carboxymethylcellulose and hydroxyethylcellulose, solvents for silver halides, e.g. sodium thiosulfate, toning agent, e.g. a mercapto toning agent such as 1-phenyl-5-mercaptotetrazole, 2-mercaptothiazoline, 2-amino-5-mercapto-1,3,4-thiazole and 2-mercapto-5-phenyl-1,3,4-oxadiazole, and developer modifiers, e.g. a heterocyclic compound such as benzotriazole, 5-nitrobenzimidazole, triazole, tetrazoles, oxazoles and thiazoles. When the mercapto toning agent and the heterocyclic compound are used their amounts should be limited to at most 1 g/l. The amount more than 1 g/l results in the suppression of development. The processing solution may also contain developer accelerators, e.g. polyoxyalkylene compounds, onium compounds, developing nuclei, e.g. those described in Brit. Pat. No. 1,001,558, and, if necessary, developing agents, e.g. hydroquinone and 1-phenyl-3-pyrazolidone.

The pH range of the processing solution is that suitable for activating the developing agent and is generally from about 10 to 14, preferably from about 12 to 14. The optimal pH for a particular DTR process varies depending on the photographic elements used, intended image, type and quantity of various compounds used in the processing composition and processing conditions.

The processing solution composition contains various compounds including those salts such as exemplified above by the alkaline substances, preservatives, antifogging agents and silver halide solvents which contain cations such as sodium, potassium, lithium and ammonium. According to this invention, a DTR image excellent in maximum density, contrast and sharpness is obtained with an accelerated transfer speed by maintaining the proportion of potassium ion in the total cation content of the processing composition within the range of 2.0 to 12.0, preferably 6.0 to 10.0, mole-% and the bromide (such as potassium bromide and sodium bromide) content of the composition within the range of $1.7\times10^{-3}$ to $1.7\times10^{-2}$, preferably $3\times10^{-3}$ to $1.2\times10^{-2}$, mole/liter.

If the processing composition contains no bromide (e.g. potassium bromide), marked fogging will be resulted, though the transfer speed becomes higher, whereas if the bromide content exceeds about $1.7\times10^{-2}$ mole/liter, not only the transfer speed becomes markedly decreased, but also the sharpness becomes inferior and the transferred silver image acquires an undesirably reddish tone.

The processing composition of this invention was found to manifest an optimal transfer speed when the bromide content is about $4\times10^{-3}$ mole/liter. When the bromide salt is potassium bromide, the amount of potassium ion contributed to the total potassium ion by the potassium bromide contained in such an amount as noted above is very small in the case of normal processing compositions. Accordingly, it is preferable to supply the potassium ion by the salts contained in comparatively large amounts such as an alkaline substance, preservative or silver halide solvent. However, if the potassium ion exceeds 12.0 mole-%, there will reappear such a disadvantage of a decrease in maximum density of the transferred silver image. Further, the salts such as an alkaline substance, preservative, and silver halide solvent used in comparatively large amounts in the DTR processing solution exert important effects. Therefore, it is also preferable to use those compounds other than the above-noted salts which have relatively small effects on the DTR development, such as, for example, potassium alum, potassium pyrosulfate, potassium nitrate and potassium sulfate.

In achieving the object of this invention, it is desirable that the processing composition contains the aforementioned substituted aminoalcohol in an amount of about 0.06 to about 0.3 mol per liter of the processing solution used in the DTR development. The processing solution of this invention containing the substituted aminoalcohol increases processing of the DTR materials, gives a silver image of high contrast and high sharpness, and markedly reduces the decrease in maximum transfer density.

The processing solution composition of this invention may contain various amines such as those described in the reference patents cited hereinbefore.

The processing conditions such as, for example, processing time and temperature for the processing solution composition of this invention is subject to no particular limitation, but may vary depending upon various factors such as, for example, the components of the photographic element and the ingredients of the processing composition.

In DTR process, as described in, for example, Brit. Pat. Nos. 1,000,115, 1,012,476 and 1,093,177, it is a common practice to incorporate a developing agent in the sensitive silver halide emulsion layer and/or an image receiving layer or other water-permeable colloid layers adjacent thereto. Consequently, the processing solution used in the development stage contains no developing agent and is a so-called alkali activation solution. The alkaline activation solution has a disadvantage that causes retardation of DTR as disclosed in Japanese Patent Publication No. 27568/64. Accordingly the application of the present invention thereto is especially effective.

The processing composition of this invention is used preferably in the form of alkaline activation processing solution composition.

The aqueous processing composition of this invention may contain, in addition to the aforementioned various compounds, other additives commonly used in DTR processing solution.

A common photographic negative element used in DTR process is composed of at least one silver halide emulsion layer disposed on a support material, the coating rate of silver halide in terms of silver nitrate being generally in the range of 0.5 to 3.5 g/m$^2$. If necessary, auxiliary coating layers such as undercoating layer, intermediate layer, protective layer, and stripping layer are applied in addition to the silver halide emulsion layer. For instance, the photographic negative element used in this invention can be applied, as overcoating for the silver halide emulsion layer, with a waterpermeable binder material described in Japanese Patent Publication Nos. 18,134/63 and 18,135/63 such as, for example, methylcellulose, sodium carboxymethylcellulose, or sodium alginate to uniformalize the image transfer, said overcoating layer being very thin in order not to substantially interfere with or suppress the diffusion. The silver halide emulsion layer of a negative element and the image receiving layer of a positive element contain one or more hydrophilic colloid substances such as, for example, gelatin, gelatin derivatives such as phthalated gelatin, cellulose derivatives such as carboxymethylcellulose and hydroxymethylcellulose, other hydrophilic high molecular colloidal substances such as dextrin, soluble starch, polyvinyl alcohol, and polystyrenesulfonic acid.

The silver halide emulsions comprise silver halides such as silver chloride, silver bromide, silver chlorobromide, or these halides further containing silver iodide, which are dispersed in the above-noted hydrophilic colloids. The silver halide emulsion can be sensitized in various ways during its manufacture of before being applied. It can be chemically sensitized in a manner well known in the art with, for example, sodium thiosulfate or alkylthiourea or with a gold compound such as, for example, gold rhodanide or gold chloride, or mixtures thereof. The emulsion is generally spectral sensitized in the range of about 530 to about 560 nm; it can also be spectral sensitized panchromatically.

The silver halide emulsion layer and/or the image receiving layer may contain any of the compounds commonly in use in the DTR system. Examples of such compounds include antifogging agents, e.g. tetrazaindenes and mercaptotetrazoles, coating aids such as saponin and polyalkylene oxides, hardening agents such as formaldehyde and chrome alum, and plasticizers.

The support material used in negative elements or image receiving elements or so-called monosheets comprising both of these elements can be any of those commonly in use. Examples of such materials include paper materials, glass materials, film materials such as cellulose acetate film, polyvinyl acetate film, polystyrene film and polyethylene terephthalate film, metal supports clad on both sides with paper, and paper supports coated on one or both sides with $\alpha$-olefin polymers such as polyethylene.

The image receiving element may contain physical development nuclei, e.g. heavy metals or sulfides thereof. One or more layers of the image receiving element can contain those substances which play important roles in forming the diffusion transfer image, such as toning agent, e.g. 1-phenyl-5-mercaptotetrazole, described in Brit. Pat. No. 561,875 and Belg. Pat. No. 502,525. The image receiving element may also contain a fixing agent, e.g. sodium thiosulfate, in an amount of about 0.1 to about 4 g/m$^2$. The image receiving elements such as those described in Japanese Patent Publication No. 27,568/64 may contain developers.

EXAMPLE 1

A positive element was prepared by disposing an image receiving layer comprising gelatin, which contained nickel sulfide nuclei and carboxymethylcellulose (gelatin:carboxymethylcellulose=4:1), on one side of a paper support, 110 g/m$^2$ in basis weight, coated on both sides with polyethylene, so that the hydrophilic colloids in the image receiving layer may amount to 3 g/m$^2$ on dry basis.

On the other hand, a negative element was prepared by providing, on the same paper support as used in the positive element, a gelatin undercoat (3 g/m$^2$ of gelatin) containing anti-halation carbon black, 1 g/m$^2$ of hydroquinone and 0.3 g/m$^2$ of 1-phenyl-4-methyl-3-pyrazolidone, and then providing on the undercoat an orthochromatically spectral sensitized gelatino silver halide emulsion layer (1 g/m$^2$ of gelatin) containing 0.2 g/m$^2$ of hydroquinone and 1.5 g/m$^2$ (in terms of silver nitrate) of silver chlorobromide (15 mole-% silver bromide) having an average grain size of 0.3$\mu$.

The emulsion layer of the negative element and the image receiving layer of the positive element were brought into contact with each other and passed through a common processor containing the following DTR processing solution. After 5 seconds or 60 seconds from the instant when the combined element had passed through the squeeze rolls, both component elements were peeled apart. The temperature of the processing solution was 20° C.

| Basic formula (A) | |
|---|---|
| Water | 800 ml |
| Sodium sulfite, anhyd. | 40 g |
| Trisodium orthophosphate | 75 g |
| Sodium hydroxide | 5 g |
| Sodium thiosulfate, cryst. | 20 g |
| Potassium bromide | 1 g |
| 1-Phenyl-5-mercaptotetrazole | 0.1 g |
| Water to make | 1 liter |

Processing solutions (B) to (K) were prepared by replacing sodium sulfite in the basic formula (A) with potassium sulfite and adjusting the concentrations of potassium ion to 2, 4, 6, 8, 10, 12, 14, 16, 20 and 50 mole-%, respectively.

The positive element treated as described above was measured for the reflection density. The results obtained were as shown in Table 1.

TABLE 1

| Processing solution | (A) | (B) | (C) | (D) | (E) | (F) | (G) | (H) | (I) | (J) | (K) |
|---|---|---|---|---|---|---|---|---|---|---|---|
| After 5 seconds | 0.61 | 0.84 | 0.94 | 1.20 | 1.29 | 1.33 | 1.35 | 1.33 | 1.31 | 1.28 | 1.24 |
| After 60 seconds | 1.35 | 1.49 | 1.51 | 1.58 | 1.65 | 1.61 | 1.54 | 1.38 | 1.30 | 1.25 | 1.21 |

It is seen from the results shown in Table 1 that the transfer speed (after 5 seconds) increases with the increase in the amount of potassium ion, then tends to decrease when the latter exceeds 16 mole-%, while the maximum densities (after 60 seconds) remain at high levels in the potassium ion range of 2 to 12 mole-% [processing solutions (B) to (G)] with a peak value at 8 mole-%. The positive images obtained by the processing solutions (B) to (G) of this invention were pure black and excellent in contrast and sharpness.

EXAMPLE 2

The procedure of Example 1 was repeated, except that in place of the processing solutions (A)-(K) those (A')-(K') each containing additionally 10 ml/liter of N-ethylaminoethanol were used. The results obtained were as shown in Table 2.

TABLE 2

| Processing solution | (A') | (B') | (C') | (D') | (E') | (F') | (G') | (H') | (I') | (J') | (K') |
|---|---|---|---|---|---|---|---|---|---|---|---|
| After 5 seconds | 0.72 | 0.93 | 1.02 | 1.27 | 1.36 | 1.40 | 1.41 | 1.41 | 1.39 | 1.36 | 1.33 |
| After 60 seconds | 1.30 | 1.46 | 1.49 | 1.58 | 1.64 | 1.60 | 1.53 | 1.35 | 1.26 | 1.19 | 1.14 |

The general tendency was similar to that in Example 1. By comparison with the results of Example 1, it is seen that the processing solution containing N-ethylaminoethyanol increases the transfer speed and somewhat decreases the maximum density. However, when the processing solutions (B') to (G') of this invention were used, the maximum density still remained at a high level, the decrease having been comparatively small.

On observation of dots obtained by contact-exposing according to the halftone process and developing the image with each processing solution for 60 seconds, it was confirmed that as compared with the processing solutions of Example 1, those of the present Example produce dots of better quality and that as compared with other solutions, particularly the processing solutions (B') to (G') give dots with less fringe and superior contrast and sharpness.

EXAMPLE 3

Experiments were run in a manner similar to that in Example 2, using processing solutions (O) to (S) which were prepared by modifying the processing solution (E') of Example 2 so as to contain 0, 0.5, 1.5, 2.5 and 3.5 g/liter of potassium bromide, respectively. The results obtained were as shown in Table 3.

TABLE 3

| Processing solution | (O) | (P) | (Q) | (R) | (S) |
|---|---|---|---|---|---|
| After 5 seconds | 1.37 | 1.45 | 1.30 | 1.13 | 1.01 |
| After 60 seconds | 1.51 | 1.62 | 1.67 | 1.68 | 1.62 |

The processing solution (O) containing no potassium bromide produced fogging in the negative element and an image of low maximum density in the positive element. Processing solutions (R) and (S) gave an image of high maximum density but was insufficient in the transfer speed and, moreover, the silver image showed an undesirable reddish brown tone. On test printing of a contact screen, the solutions (R) and (S) gave dots with inferior sharpness and inferior quality. It was confirmed from the results that the processing solutions (P) and (Q) according to this invention have favorable transfer characteristics, exhibiting none of the above-noted defects.

EXAMPLE 4

The procedure of Example 2 was repeated, except that in the use of processing solutions (A'), (C'), (E'), (G'), (H') and (J') "Hishi-rapid PF" (a positive element with a transparent polyester film support; a product of Mitsubishi Paper Mills, Ltd.) was used as the positive element. The results of transmission density measurement were as shown in Table 4.

TABLE 4

| Processing solution | (A') | (C') | (E') | (G') | (H') | (J') |
|---|---|---|---|---|---|---|
| After 45 seconds | 3.25 | 3.51 | 3.58 | 3.44 | 3.28 | 3.10 |

What is claimed is:

1. A silver complex diffusion transfer processing solution composition containing substantially no developing agent which comprises:

(1) an alkaline substance,
(2) an alkali metal sulfite,
(3) a solvent for silver halides which is other than sulfite,
(4) $1.7\times10^{-3}$ to $1.7\times10^{-2}$ mole/liter of a bromide,
(5) a content of potassium ion of 2.0 to 12.0 mol % based on the total cations of the salts contained in the composition, and
(6) water.

2. A silver complex diffusion transfer processing solution composition according to claim 1 wherein the solvent (3) is an alkali metal thiosulfate.

3. A silver complex diffusion transfer processing solution composition according to claim 1 wherein the sulfite (2) is sodium sulfite.

4. A silver complex diffusion transfer processing solution composition according to claim 1 wherein the solvent (3) is sodium thiosulfate.

5. A silver complex diffusion transfer processing solution composition according to claim 1 wherein the content of potassium ion (5) is 6 to 10 mol % based on the total cations of the salts contained in the composition.

6. A silver complex diffusion transfer processing solution composition according to claim 1 wherein the content of the bromide (4) is $3\times10^{-3}$ to $1.2\times10^{-2}$ mol/liter.

7. A silver complex diffusion transfer processing solution composition according to claim 1 which contains salts compounds other than those of (1), (2), (3), and (4).

8. A silver complex diffusion transfer processing solution composition according to claim 1 which additionally contains at least one member selected from a thickener, a toning agent, a developer modifier, and a developer accelerator.

9. A silver complex diffusion transfer processing solution composition according to claim 8 including a toning agent and wherein the toning agent is a mercapto compound and is contained in an amount not more than one gram/liter.

10. A silver complex diffusion transfer processing solution composition according to claim 8 including a developer modifier and wherein the developer modifier is a heterocyclic compound and is contained in an amount not more than one gram/liter.

11. A silver complex diffusion transfer processing solution composition according to claim 1 which has a pH of 10–14.

12. A silver complex diffusion transfer processing solution composition according to claim 1 which contains an aminoalcohol.

13. A silver complex diffusion transfer processing solution composition according to claim 12 wherein the aminoalcohol is represented by the general formula:

$R\text{-}NH\text{-}CH_2H_4OH$ wherein R is a $C_1$–$C_4$ alkyl.

14. A silver complex diffusion transfer processing solution composition according to claim 13 wherein the content of the aminoalcohol is about 0.06 to about 0.3 mol/liter.

15. A silver complex diffusion transfer processing solution composition according to claim 1 wherein the sulfite (2) is sodium sulfite or potassium sulfite and the solvent (3) is sodium thiosulfate.

* * * * *